US012359453B2

(12) United States Patent
Gneckow, Jr.

(10) Patent No.: US 12,359,453 B2
(45) Date of Patent: Jul. 15, 2025

(54) CARPET CUTTING APPARATUS AND A METHOD AND SYSTEM FOR REMOVING CARPET BONDED TO A FLOOR

(71) Applicant: Elwood Louis Gneckow, Jr., Royal Oak, MI (US)

(72) Inventor: Elwood Louis Gneckow, Jr., Royal Oak, MI (US)

( * ) Notice: Subject to any disclaimer, the term of this patent is extended or adjusted under 35 U.S.C. 154(b) by 656 days.

(21) Appl. No.: 17/234,219

(22) Filed: Apr. 19, 2021

(65) Prior Publication Data

US 2021/0238873 A1 Aug. 5, 2021

Related U.S. Application Data

(63) Continuation-in-part of application No. 15/596,539, filed on May 16, 2017, now Pat. No. 10,132,094.

(51) Int. Cl.
*E04G 23/00* (2006.01)

(52) U.S. Cl.
CPC ..... *E04G 23/006* (2013.01)

(58) Field of Classification Search
CPC . E04G 23/006; B32B 43/006; B32B 2419/00; B66D 1/60; B66D 1/12; B66D 1/28; Y10T 156/1168; Y10T 156/1978; Y10S 156/929; Y10S 156/94
See application file for complete search history.

(56) References Cited

U.S. PATENT DOCUMENTS 5,909,868 A * 6/1999 Galella ..... E04G 23/006 254/211
10,132,094 B1 * 11/2018 Gneckow, Jr. ..... B66D 1/12
2006/0180799 A1 * 8/2006 Rannikko ..... E04G 23/006 254/202
2018/0334820 A1 * 11/2018 Gneckow, Jr. ..... B66D 1/60

FOREIGN PATENT DOCUMENTS

JP 2009144459 A * 7/2009

OTHER PUBLICATIONS

Translation of JP-2009144459-A, Jul. 2009, Hishida M (Year: 2009).*

* cited by examiner

*Primary Examiner* — George R Koch
(74) *Attorney, Agent, or Firm* — Jacob M. Ward; Ward Law Office LLC

(57) ABSTRACT

A carpet cutting apparatus comprises a bottom plate and a blade-mounting structure. The bottom plate has a rear flat portion, and a front pointed and slanted tip; and the blade-mounting structure comprises a rear base plate and a forward hood portion, the forward hood portion is configured to engage a blade within a blade holder by means of plurality of screws. The forward hood portion is configured to have a hole to engage a cable hook. A system of carpet cutting and removing comprises a winch connected to a first end of a cable, a carpet cutting apparatus, and a diverter. It provides easy cutting of carpet into carpet strips which can be pulled by means of clamps and winch action. During operation, the base plate capable of receiving a foot of an operator at foot area of the carpet cutting apparatus, to avoid lifting from rear portion.

8 Claims, 9 Drawing Sheets

CARPET CUTTING APPARATUS AND A METHOD AND SYSTEM FOR REMOVING CARPET BONDED TO A FLOOR

TECHNICAL FIELD

The present invention generally relates to apparatus for the removal of carpeting from a floor and more particularly the invention relates to a carpet cutting apparatus and a method and system for removing carpet from a floor.

BACKGROUND

In recent times, the installation of carpeting on the floors of homes, office or commercial buildings such as airport, theatres and the like usually require bonding to the floor. However, it is a difficult task to remove the carpet from the floor when it becomes necessary either due wear and tear, or to replace the carpet with another one. Further, in commercial spaces large size carpet are installed and due to various pillars or other obstructions, removing the big size carpet become difficult task. Hence there is a need of carpet cutting apparatus which can be employed easily for motorized removal of the carpets.

In one of the prior art U.S. Pat. No. 10,132,094 B1 that describes a carpet pulling apparatus including a base including a top surface and a bottom surface opposite the top surface. The bottom surface includes a plurality of spikes. A winch is attached to the top surface of the base. A cable extends from a first end to a second end. The first end is received by the winch. A clamp is attached to the second end of the cable. A diverter is configured to receive the cable at a location between the first end and the second end and divert a direction of extension of the cable. The diverter is capable of being moved relative to the base. However, the US patent fails to disclose a carpet cutting apparatus that can be used to cut a large size carpet into a predetermined size of stripes so that easier removal of carpet is performed. The patent also fails to provide simultaneous cutting of carpet stripes by means of carpet cutting apparatus and removal of strips by means of winch and clamps.

In another art, U.S. Pat. No. 6,647,628B1 describes about a carpet cutter that includes a blade-supporting structure and a tuft-parting structure. The blade-supporting structure includes a longitudinally extending guide with a forward portion and a carpet-contacting edge that extends along a first axis toward the forward portion of the guide. A blade is mounted adjustably on the blade-supporting structure in a carpet-cutting position of the blade. The tuft-parting structure is on the forward portion of the guide where it functions as means for parting tufts on the carpet to facilitate cutting a backing portion of the carpet without cutting the tufts. The tuft-parting structure includes an elongated member with a tip. The elongated member protrudes forwardly beyond the forward end portion of the guide along a second axis that intersects the first axis, thereby to facilitate positioning of the tip of the elongated structure in between adjacent tufts of the carpet. However, present cutter can't perform the easy carpet cutting and pulling the carpet for the removal of the carpet in motorized system with less manual labour.

In another relevant art, U.S. Pat. No. 4,064,627A describes a carpet cutter having a base with guiding side edges and having a vertical frame. The frame carries a pair of downwardly diverging blades, each of which intersects a carpet slot, and a handle is affixed to the top of the frame so that the cutter may be used conveniently in either direction or by either hand. However, this relevant art fails to describe a carpet that can be employed with motorized carpet cutting and pulling mechanism with minimum manual labour.

To overcome the above-mentioned shortcoming, an improved carpet cutting apparatus and a method and system for removing carpet from a floor at great ease and convenience.

SUMMARY OF THE INVENTION

In accordance with a preferred embodiment of the invention, the present objective of the invention is to provide a carpet cutting apparatus/carpet cutter. The carpet cutting apparatus comprises a bottom plate and a blade-mounting structure. The bottom plate has a rear flat portion, and a front pointed and slanted tip; and the blade-mounting structure comprises a rear base plate and a forward hood portion, wherein the forward hood portion is configured to engage a blade, wherein one end of the blade engages within a blade holder having grooves along the vertical plane by means of plurality of screws and other end of the blade is supported at the bottom plate. In the embodiment, the forward hood is configured to have a hole to engage a cable hook. In the embodiment the rear base plate is mounted on the bottom plate by means of a plurality of screws, wherein the front pointed and slanted tip of the bottom plate made to puncture carpet which moves along the slanted area to reach the blade and cut the carpet. In the embodiment, the position of hole to engage hook of a cable is frontal and top of the forward hood portion. In another embodiment, instead of hole, hook may be employed to engage a cable.

In an embodiment, the base plate comprises a handle in the middle or at appropriate place to be held by an operator during carpet cutting operation. In another embodiment, the handle may be removable and can be engaged with base handle receiver which is hollow and larger diameter than the handle such as male-female type fitting arrangement. In an embodiment, the base plate at rear portion has foot area which is capable of receiving a foot of an operator. The foot area is made to put foot of an operator while the handle allows the operator to grip the handle, and keep the cutter moving in case the cutter lifts from rear portion due to pulling force. The handle may act as guide to the cutting operation.

In an embodiment, the front pointed, and slanted tip of the bottom plate comprises an elongated member which is conically shaped. The base plate and bottom plate may be replaceable.

In an embodiment, the forward hood portion comprises a "L" shaped blade holder consists of two screw holes that engages with corresponding crew holes of blade in order to fit the blade by means of screws.

In an embodiment, a system for carpet cutting and pulling is disclosed, the system comprising a winch connected to a first end of a cable, a carpet cutting apparatus, and a diverter, wherein the diverter configured to receive the cable at a location between the first end and a second end of the cable and divert a direction of extension of the cable. In an embodiment, the second end of the cable is connected to the hole of the carpet cutting apparatus. In the embodiment, the base plate of the carpet cutting apparatus capable of receiving a foot of an operator at foot area of the carpet cutting apparatus, wherein the foot area is to put foot and keep the cutter moving in order to avoid lifting of the carpet cutting apparatus from rear portion due to pull force, wherein the front pointed and slanted tip of the bottom plate of the carpet cutting apparatus made to puncture carpet which moves along the slanted area to reach the blade and cut the carpet.

In an embodiment, two parallel carpet cutting apparatus is engaged in accordance to the engagement arrangement to obtain a strip of the carpet, which can be later on pulled by engaging with clamp.

In another embodiment, the second end of the cable is connected to a pulley through a diverter. In the embodiment, a second cable extending from a first end to a second end, the second cable engaging the pulley at a location between first end and the second end of the second cable, wherein one carpet cutting apparatus is attached to the first end of the second cable, and a second carpet cutting apparatus is attached to the second end of the second cable. In an another embodiment, a third cable extending from a first end to a second end, the third cable engaging the pulley at a location between first end and the second end of the third cable, wherein one clamp is attached to the first end of the third cable, and second clamp is attached to the second end of the third cable. In another embodiment, at one end of the cable, a carpet cutting apparatus is engaged while at second end, clamp may be attached. In accordance to the arrangements of the cable, winch, diverter and pulley aforesaid, more than two cable may be employed using a single or multiple pulley with or without diverter to simultaneously cut the carpet in strips and remove the strips of the carpet with least manual labor.

In the embodiment, a winch is employed to pull carpet cutting apparatus because of which strips of the carpet is cut which is pulled by locking mechanism of the clamp by means of cable, pulley and diverter. In the embodiment, the winch is power driven and when the winch is turned on the carpet cutting apparatus and/or clamp are pulled by the help of cable, pulley and guiding diverter and stripes of the carpet are cut and removed.

In the embodiment, the winch has four wheel which can be locked so that it can't skid on the carpet. That because of pulling mechanism of the winch, carpet strips are removed from a floor whether it is large surface area such as airport, hotels or other commercial spaces.

The invention discloses, a method of cutting carpet adhesively bonded to a floor surface, comprising the steps of: a. loosening an edge of a carpet on a floor, b. placing a carpet cutting apparatus to the loosen edge of the carpet, c. anchoring a first end of a cable to a winch, and anchoring a second end of the cable with a pulley or the carpet cutting apparatus through diverter; d. energizing the power driven winch to apply a pulling force to the first end of the cable; e. placing a foot of an operator at foot area of the carpet cutting apparatus; f. cutting the carpet into strips when the carpet cutting apparatus moves due to pulling force wherein front pointed and slanted tip of a bottom plate of the carpet cutting apparatus punctures carpet which moves along the slanted area to reach the blade and cut the carpet.

In another embodiment, the method provides removing the cut strips of carpet, wherein second end of the cable anchored with pulley or clamp locked with the cut strips of the carpet. In the embodiment, attaching a first end of a second cable to a carpet cutting apparatus and second end of the cable with the another carpet cutting apparatus. In another embodiment, the method provides, attaching first end of a third cable to a clamp and a second end to another clamp, wherein pulley is engaged between first and second end. In the embodiment, the diverter is capable of moving relative to base.

To further clarify advantages and features of the present invention, a more particular description of the invention will be rendered by reference to specific embodiments thereof, which is illustrated in the appended drawings. It is appreciated that these drawings depict only typical embodiments of the invention and are therefore not to be considered limiting of its scope. The invention will be described and explained with additional specificity and detail with the accompanying drawings.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

Figure 1:
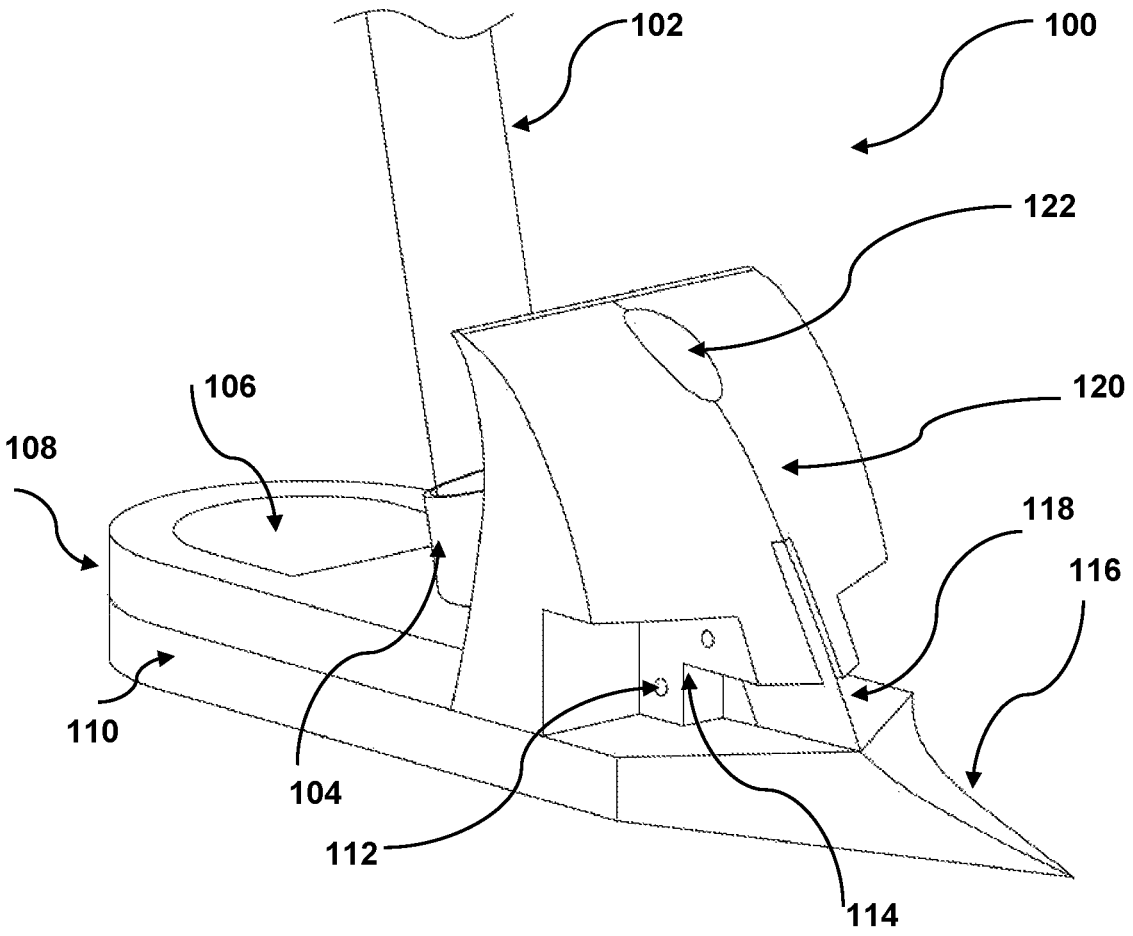
FIG. 1 is a perspective view of the carpet cutting apparatus according to the preferred embodiment of the invention.

Further, skilled artisans will appreciate that elements in the drawings are illustrated for simplicity and may not have necessarily been drawn to scale. For example, the flow charts illustrate the method in terms of the most prominent steps involved to help to improve understanding of aspects of the present invention. Furthermore, in terms of the construction of the device, one or more components of the device may have been represented in the drawings by conventional symbols, and the drawings may show only those specific details that are pertinent to understanding the embodiments of the present invention so as not to obscure the drawings with details that will be readily apparent to those of ordinary skill in the art having benefit of the description herein.

DETAILED DESCRIPTION OF THE INVENTION

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated system, and such further applications of the principles of the invention as illustrated therein being contemplated as would normally occur to one skilled in the art to which the invention relates.

It will be understood by those skilled in the art that the foregoing general description and the following detailed description are exemplary and explanatory of the invention and are not intended to be restrictive thereof.

Reference throughout this specification to "an aspect", "another aspect" or similar language means that a particular feature, structure, or characteristic described in connection with the embodiment is included in at least one embodiment of the present invention. Thus, appearances of the phrase "in an embodiment", "in another embodiment" and similar language throughout this specification may, but do not necessarily, all refer to the same embodiment.

The terms "comprises", "comprising", or any other variations thereof, are intended to cover a non-exclusive inclusion, such that a process or method that comprises a list of steps does not include only those steps but may include other steps not expressly listed or inherent to such process or method. Similarly, one or more devices or sub-systems or elements or structures or components proceeded by "comprises . . . a" does not, without more constraints, preclude the existence of other devices or other sub-systems or other elements or other structures or other components or additional devices or additional sub-systems or additional elements or additional structures or additional components.

Unless otherwise defined, all technical and scientific terms used herein have the same meaning as commonly understood by one of ordinary skill in the art to which this invention belongs. The system, methods, and examples provided herein are illustrative only and not intended to be limiting.

Embodiments of the present invention will be described below in detail with reference to the accompanying drawings.

Figure 2:
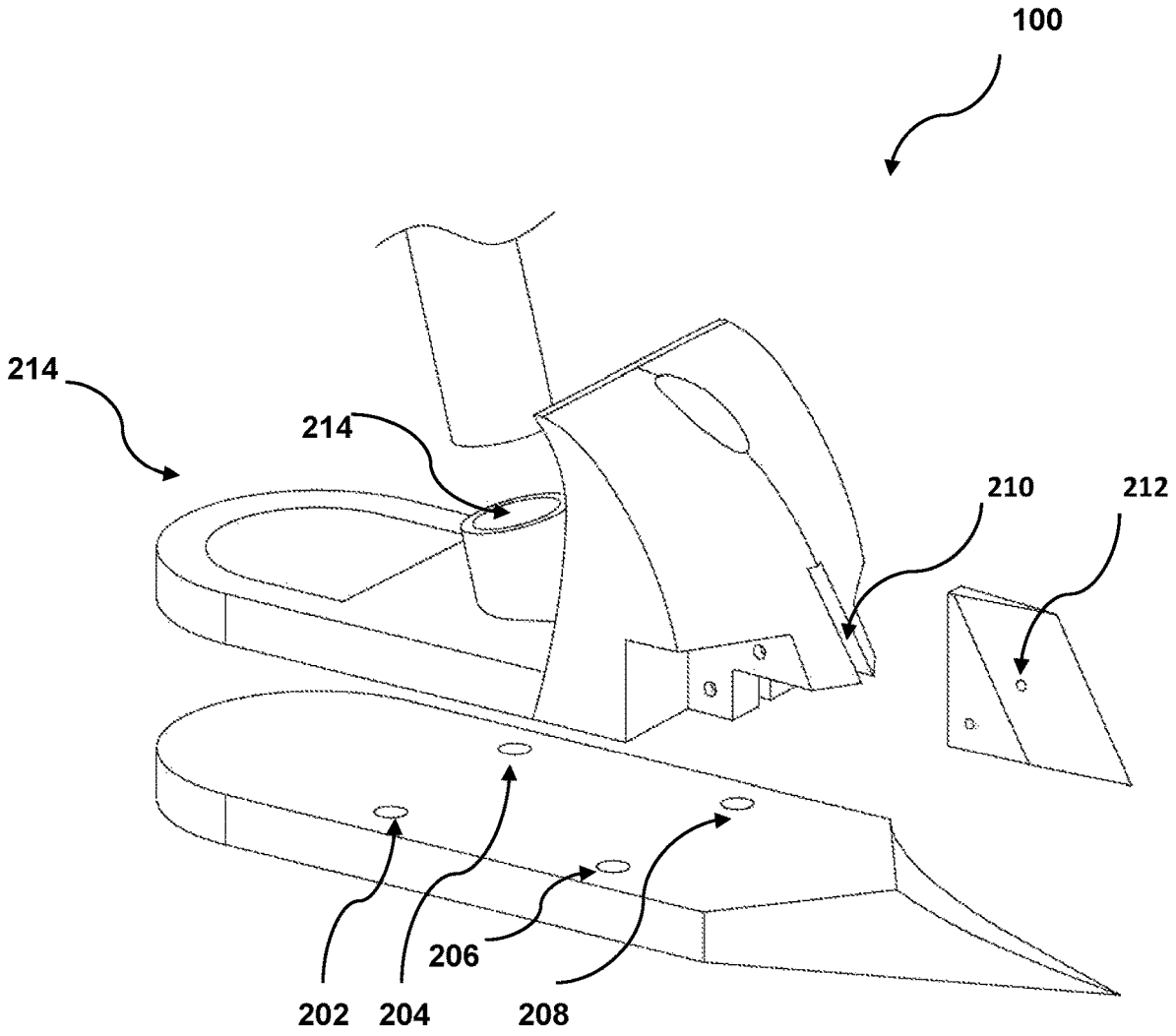
FIG. 2 is an exploded view of carpet cutting apparatus according to preferred embodiment of the invention.

Referring to FIG. 1 and FIG. 2, the present invention provides a carpet cutting apparatus/carpet cutter 100. The carpet cutting apparatus 100 comprises a bottom plate 110 and a blade-mounting structure 214. The bottom plate 110 has a rear flat portion, and a front pointed and slanted tip 116; and the blade-mounting structure comprises a rear base plate 108 and a forward hood portion 120, wherein the forward hood portion 120 is configured to engage a blade 118, wherein one end of the blade 118 engages with a blade holder 114 by means of plurality of screws 112 and other end of the blade is supported at the bottom plate. In the embodiment, the forward hood portion 120 is configured to have a hole 122 to engage a cable hook. The rear base plate 108 is mounted on the bottom plate 110 by means of a plurality of screws 202, 204, 206, 208, wherein the front pointed and slanted tip 116 of the bottom plate 110 made to puncture carpet which moves along the slanted area to reach the blade and cut the carpet. In the embodiment, the position of hole to engage hook of a cable is frontal and top of the forward hood portion. In another embodiment, instead of hole, hook may be employed to engage a cable.

Figure 8:
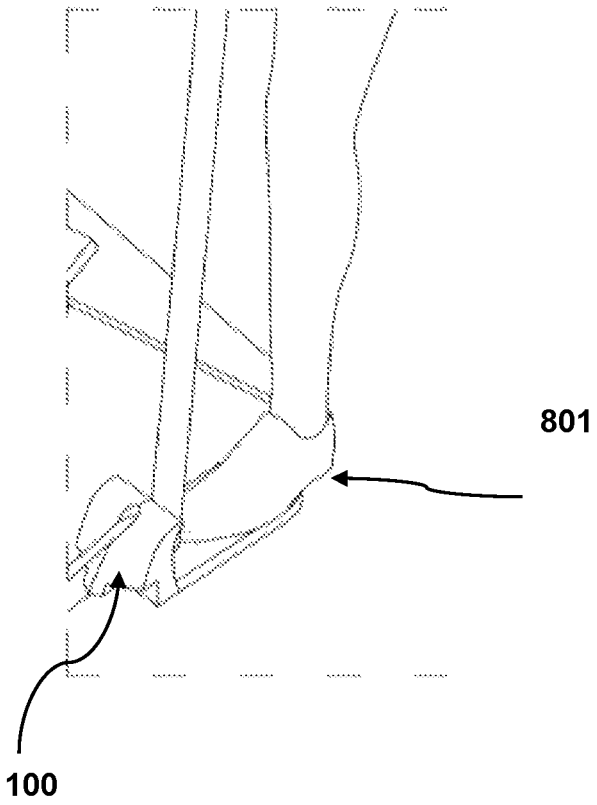
FIG. 8 shows an operator put the foot at foot area of the carpet cutting apparatus in accordance to the embodiments of the invention.
Figure 9:
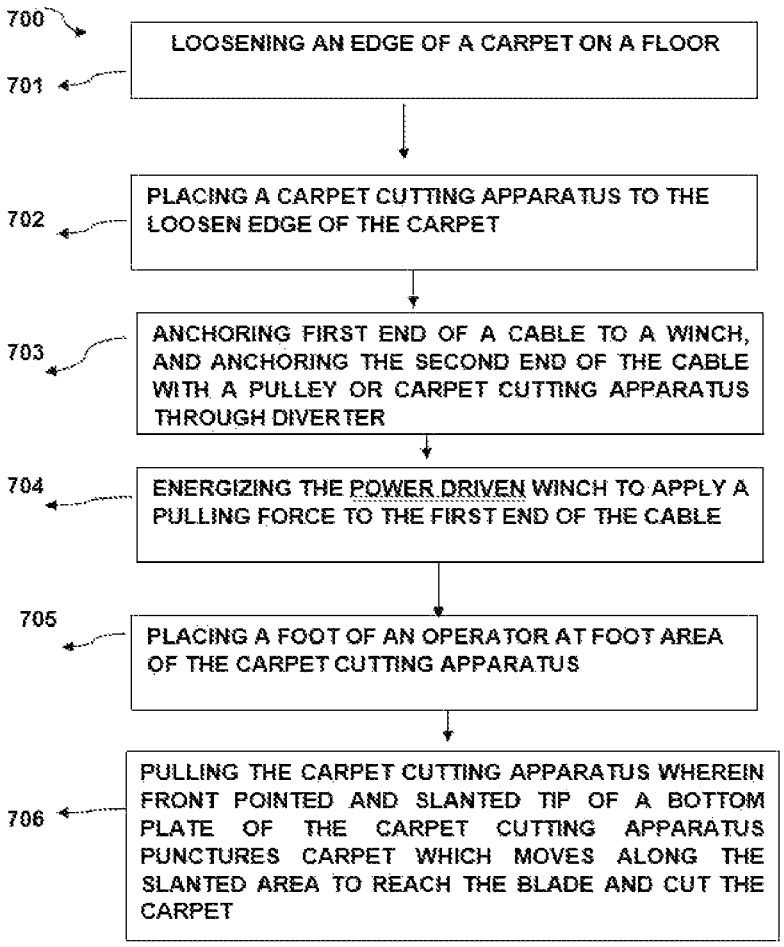
FIG. 9 shows flow chart to show method of cutting a carpet strip by carpet cutting apparatus.

In an embodiment referring to FIG. 1, 2 and FIG. 8, the base plate 110 comprises a handle 102 in the middle or at appropriate place to be held by an operator during carpet cutting operation. In another embodiment, the handle may be removable and can be engaged with base handle receiver 104 which is hollow 214 and larger in diameter than the handle such as male-female type fitting arrangement. The base plate 110 at rear portion has foot area 106 which is capable of receiving a foot of an operator. The foot area is made to put foot of an operator while the handle allows the operator to grip the handle, and keep the cutter moving in case the cutter lifts from rear portion due to pulling force. The handle may act as guide to the cutting operation.

Referring to FIG. 2, the forward hood portion comprises a "L" shaped blade holder 114 consists of two screw holes 112 that engages with corresponding crew holes 212 of blade 118 in order to fit the blade by means of screws. The blade holder 114 comprises a vertically groove 210 to engage the blade 118.

Figure 3:
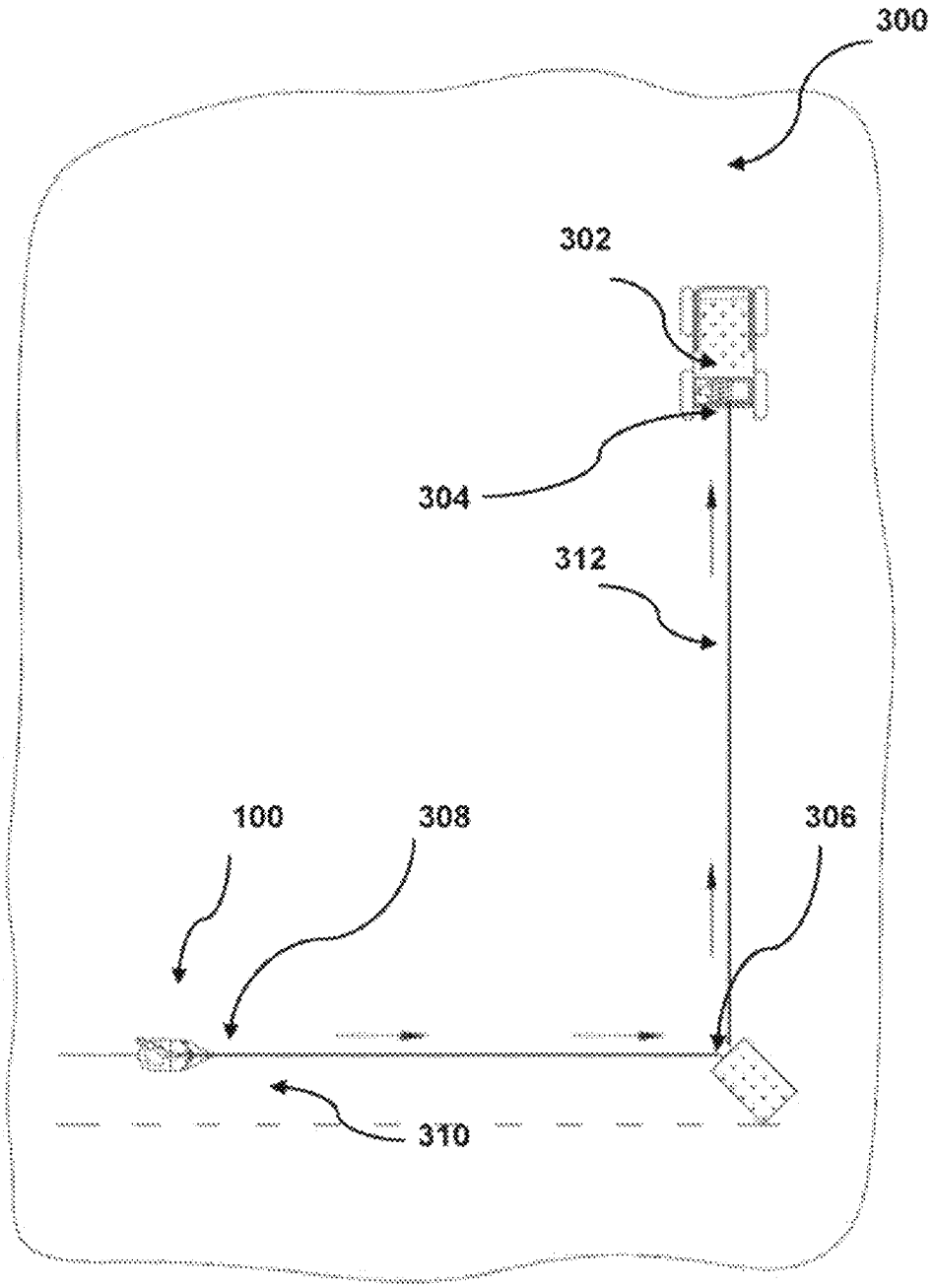
FIG. 3 shows a system of carpet cutting using single carpet cutting apparatus in accordance to the preferred embodiment of the invention.

Referring to FIG. 3, a system for carpet cutting 300 in an embodiment is disclosed. The system 300 comprising a winch 302 extending a first end 304 of a cable 312, and a second end 308 of the cable 312 is connected to a carpet cutting apparatus 100, through a diverter 306, wherein the diverter configured to receive the cable at a location between the first end and a second end of the cable and divert a direction of extension of the cable. The second end 308 of the cable 312 is connected to the hole of the carpet cutting apparatus. Referring to FIG. 1, 2, 3, 8, the base plate 108 of the carpet cutting apparatus 100 capable of receiving a foot of an operator at foot area 106 of the carpet cutting apparatus, wherein the foot area is to put foot and keep the cutter moving in order to avoid lifting of the carpet cutting apparatus from rear portion due to pull force, wherein the front pointed and slanted tip of the bottom plate of the carpet cutting apparatus made to puncture carpet which moves along the slanted area to reach the blade and cut the carpet and thereby a strip 310 of carpet is cut.

Figure 4:
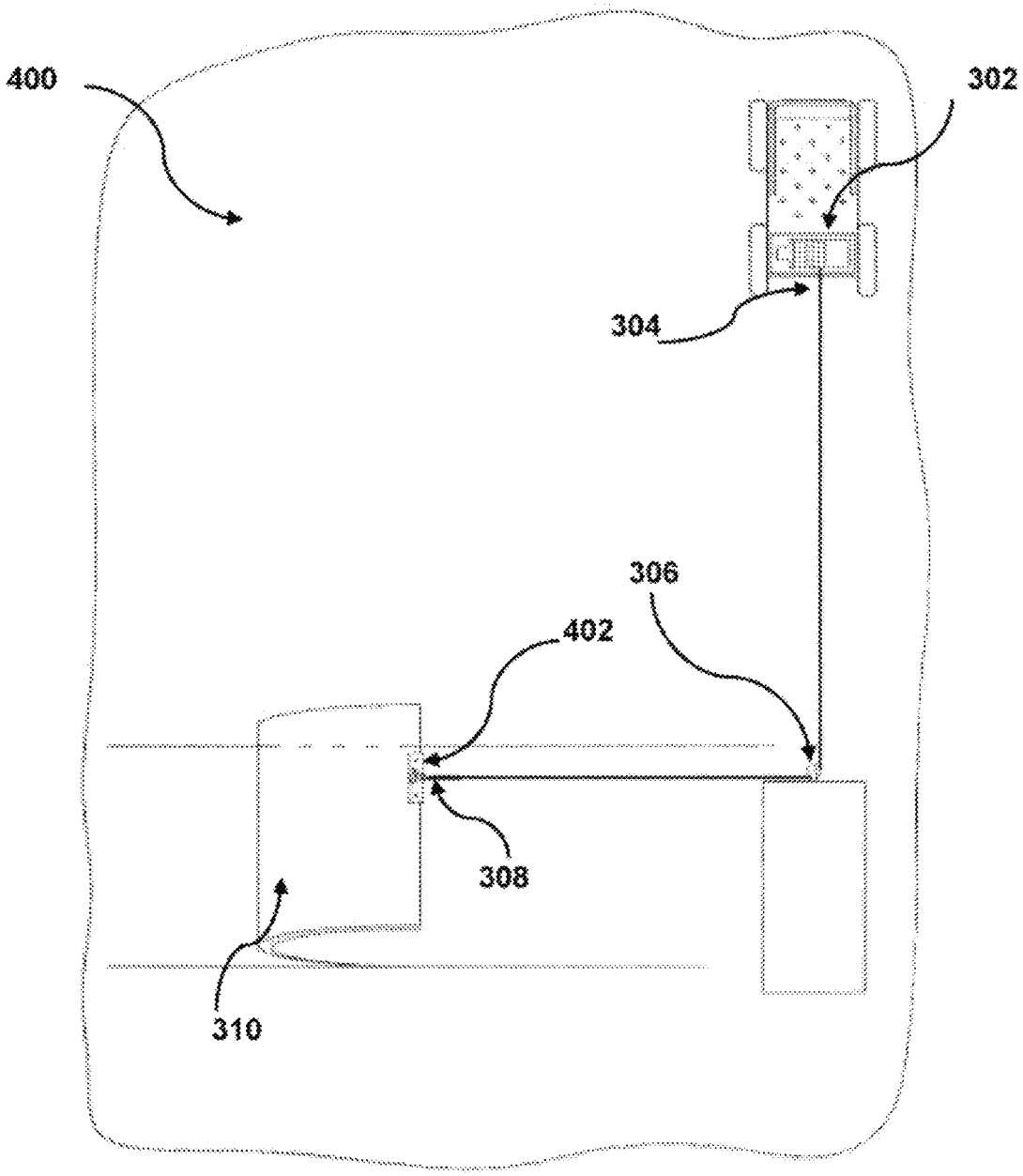
FIG. 4 shows a system to pull a strip of carpet according to the preferred embodiment of the invention.

Referring to FIG. 4, the cable 312 extends from winch 302, at first end 304, and attached to the strip 310 of the carpet by means of clamp 402 at second end 308. In the embodiment, the strip of carpet is removed by pull force of the winch in motorized mechanism.

Figure 5:
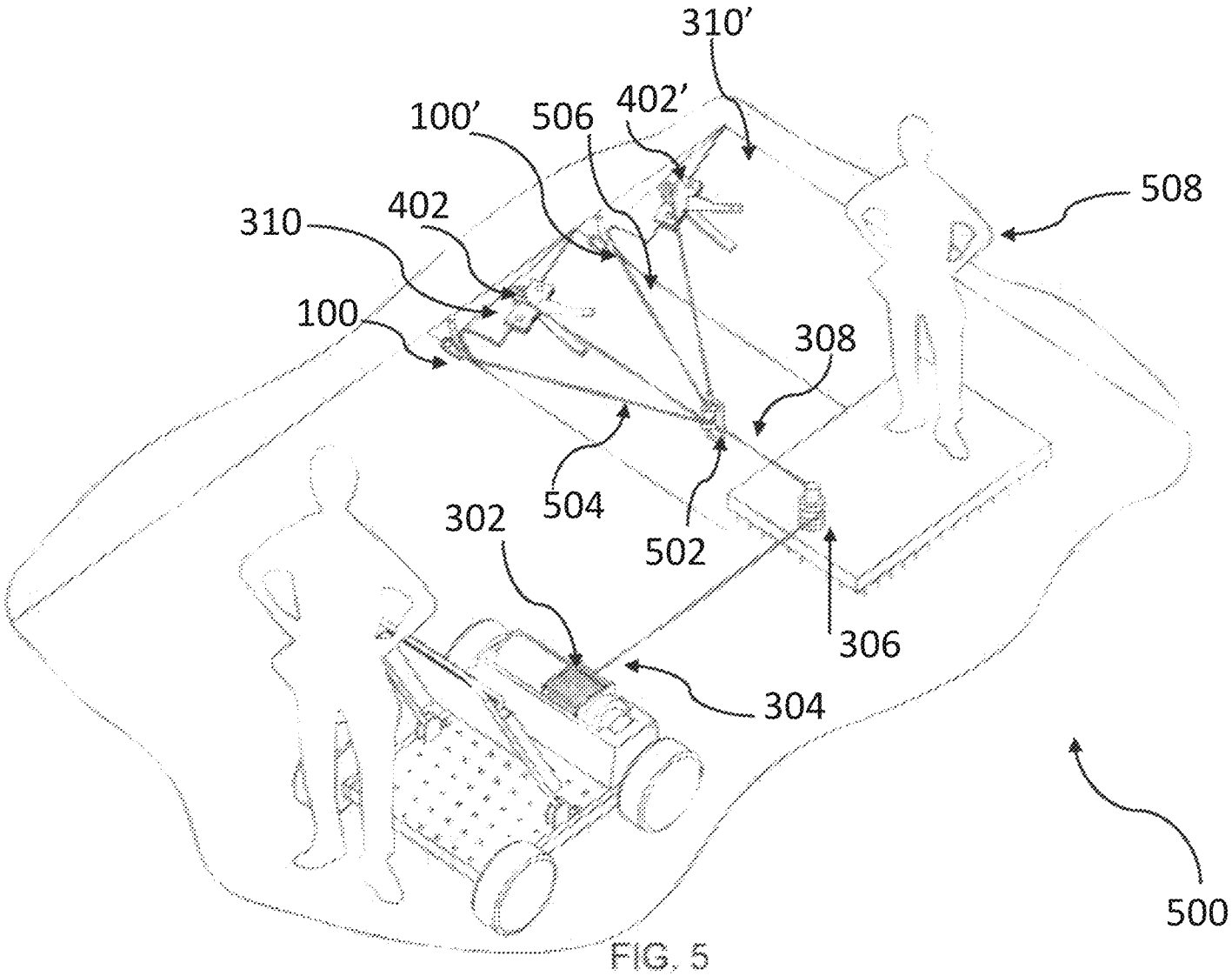
FIGS. 5 & 6 show a system to cut carpet strips and remove the strips from the floor in accordance to the preferred embodiment of the invention.

In an embodiment, two parallel carpet cutting apparatus is engaged in accordance to the engagement arrangement to obtain two strip of the carpet, which can be simultaneously or alternatively pulled by engagement with clamp. Referring to FIG. 5, a system of cutting and removing the carpet 500 is disclosed. The second end 308 of the cable 312 is connected to a pulley 502 through a diverter 306. In the embodiment, a second cable 504 extending from a first end to a second end, the second cable engaging the pulley 502 at a location between first end and the second end of the second cable, wherein one carpet cutting apparatus 100 is attached to the first end of the second cable, and a second carpet cutting apparatus 100' is attached to the second end of the second cable. In the embodiment, a third cable 506 extending from a first end to a second end, the third cable engaging the pulley 502 at a location between first end and the second end of the third cable, wherein one clamp 402 is attached to the first end of the third cable, and second clamp 402' is attached to the second end of the third cable. In the embodiment, due to winch mechanical pull force, the strip 310, 310' are cut and removed simultaneously. In another embodiment, at one end of the cable, a carpet cutting apparatus is engaged while at second end, clamp may be attached. In accordance to the arrangements, of the cable, winch, diverter and pulley aforesaid, more than two cable may be employed using a single or multiple pulley with or without diverter to simultaneously cut the carpet in strips and remove the strips of the carpet with least manual labor.

Figure 6:
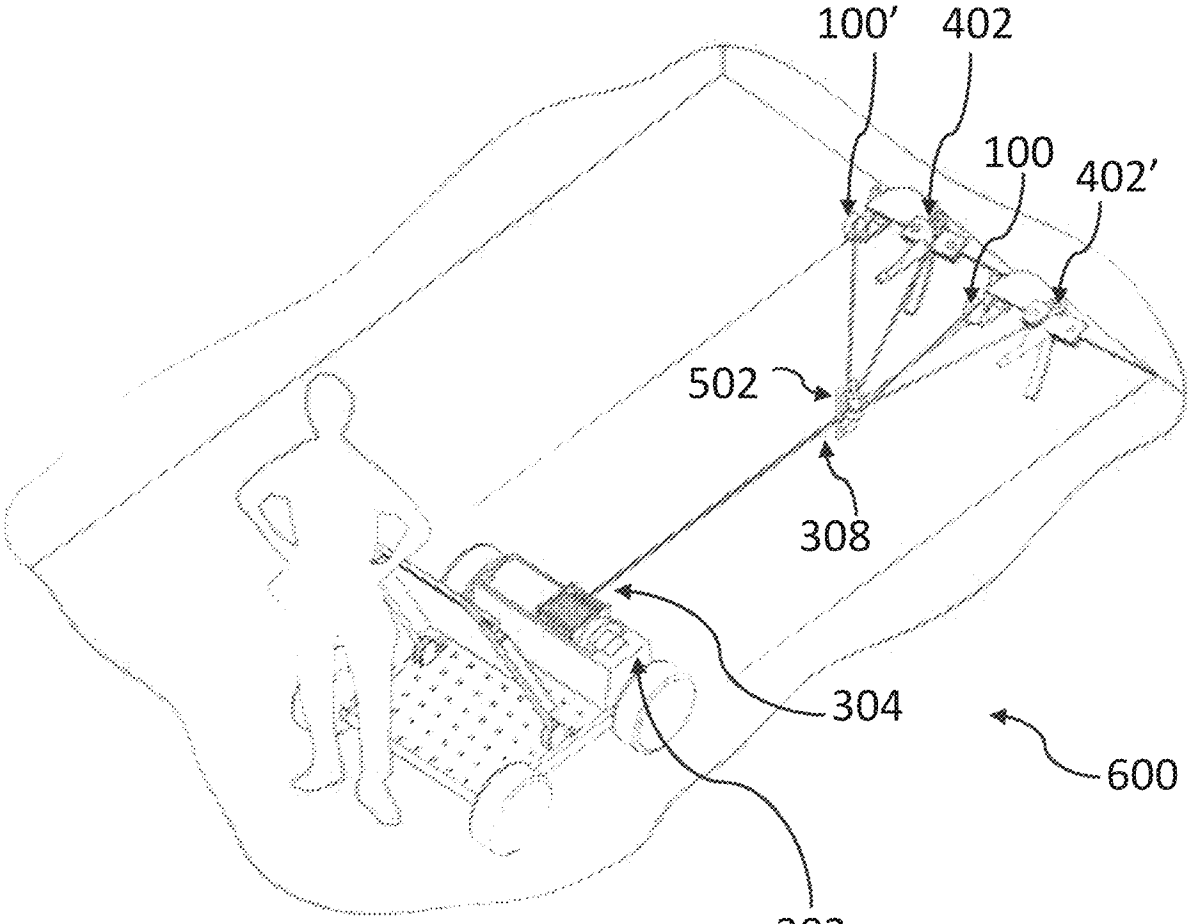
Figure 7:
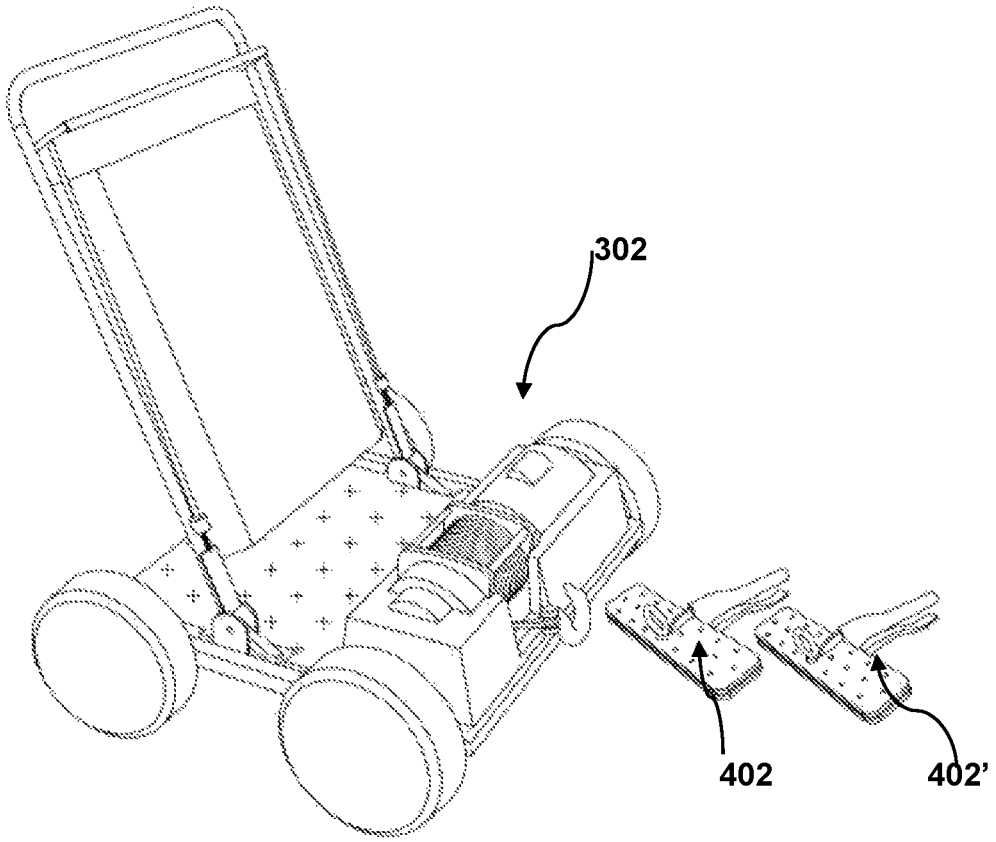
FIG. 7 of the drawings is a perspective view of the carpet pulling Trolley and clamps.

Referring to FIG. 6, a system 600 for simultaneous cutting and removing the carpet is disclosed without diverter. In this system, a cable 312 extends from the winch 302 and connected to directly to pulley 502 without diverter. The system can be employed where there is no obstruction such as pillar or other obstruction. The second and third cable are engaged carpet cutting apparatus 100, 100' and clamp 402, 402', wherein the winch 302 employed to pull carpet cutting apparatus because of which strips of the carpet is cut and the strips of carpet are pulled by winch. The clamps are attached with the strip of the carpet by locking mechanism of the clamp by means of cable and pulley. In the embodiment, the winch is power driven and when the winch is turned on the carpet cutting apparatus and/or clamp are pulled by the help of cable, pulley and stripes of the carpet are cut and removed. In the embodiment, the winch has four wheel which can be locked so that it can't skid on the carpet. That because of pulling mechanism of the winch, carpet strips are removed from a floor whether it is large surface area like airport, hotels or other commercial spaces.

Referring to 7, and 8, the invention discloses a pulling trolley comprises a winch may include a motor and a drum. The motor rotates the drum, and allows the cable 312 to either wrap around the drum or to release from the drum, depending on a direction of rotation. The motor may be electric, gas-powered, hand-powered via a crank, etc. With respect to the floor plane, the drum may be vertical, horizontal, or any other suitable configuration. The wheels have locking mechanism to lock at place to avoid skidding. The FIG. 8 shows food 801 of an operator.

The invention discloses, a method 700 of cutting carpet adhesively bonded to a floor surface, comprising the steps of: loosening an edge of a carpet on a floor 701, placing a carpet cutting apparatus to the loosen edge of the carpet 702, anchoring first end of a cable to a winch, and anchoring the second end of the cable with a pulley or carpet cutting apparatus through diverter 703; energizing the power driven winch to apply a pulling force to the first end of the cable 704; placing a foot of an operator at foot area of the carpet cutting apparatus 705; pulling the carpet cutting apparatus wherein front pointed and slanted tip of a bottom plate of the carpet cutting apparatus punctures carpet which moves along the slanted area to reach the blade and cut the carpet 706.

In another embodiment, the method provides removing the cut strips of carpet, wherein second end of the cable anchored with pulley or clamp locked with the cut strips of the carpet. In the embodiment, attaching a first end of a second cable to a carpet cutting apparatus and second end of the cable with the another carpet cutting apparatus. In another embodiment, the method provides, attaching first end of a third cable to a clamp and a second end to another clamp, wherein pulley is engaged between first and second end. In the embodiment, the diverter is capable of moving relative to base.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component of any or all the claims.

What is claimed is:

1. A carpet cutting apparatus comprising:

a bottom plate, the bottom plate has a rear flat portion, and a front pointed and slanted tip;

a blade-mounting structure, the blade-mounting structure comprises a rear base plate and a forward hood portion, wherein the forward hood portion is configured to engage a blade, the forward hood portion comprises an arc;

wherein the rear base plate comprises a removable handle engaged with a base handle receiver, the base handle receiver has a larger diameter than a diameter of the removable handle;

wherein the bottom plate and the blade-mounting structure are replaceable;

wherein one end of the blade engages with a blade holder by a plurality of screws, the blade holder is "L" shaped;

the forward hood portion is configured to have a hole to engage a cable hook;

the rear base plate is mounted on the bottom plate by another plurality of screws; and, wherein the front pointed and slanted tip of the bottom plate comprises an elongated member which is made to puncture carpet which moves along the front pointed and slanted tip to reach the blade and cut the carpet.

2. The carpet cutting apparatus as claimed in claim 1, wherein the hole to engage the cable hook is formed at a top of the forward hood portion.

3. The carpet cutting apparatus as claimed in claim 1, wherein the rear base plate is capable of receiving a foot of an operator at a foot area of the rear base plate.

4. The carpet cutting apparatus as claimed in claim 3, wherein the foot area is capable of receiving the foot of the operator and keep the carpet cutting apparatus moving in case the carpet cutting apparatus lifts from the rear flat portion due to pulling.

5. The carpet cutting apparatus as claimed in claim 1, wherein the tip of the elongated member of the front pointed and slanted tip is conically shaped.

6. A method of cutting and removing carpet adhesively bonded to a floor surface with a carpet cutting apparatus, the method comprising the steps of:

providing the carpet cutting apparatus, wherein the carpet cutting apparatus includes:

a bottom plate, the bottom plate has a rear flat portion, and a front pointed and slanted tip, a blade-mounting structure, the blade-mounting structure comprises a rear base plate and a forward hood portion, wherein the forward hood portion is configured to engage a blade, the forward hood portion comprises an arc, wherein the rear base plate comprises a removable handle engaged with a base handle receiver, the base handle receiver has a larger diameter than a diameter of the removable handle, wherein the bottom plate and the blade-mounting structure are replaceable, wherein one end of the blade engages with a blade holder by a plurality of screws, the blade holder is "L" shaped, the forward hood portion is configured to have a hole to engage a cable hook, the rear base plate is mounted on the bottom plate by another plurality of screws, and wherein the front pointed and slanted tip of the bottom plate comprises an elongated member which is made to puncture carpet which moves along the front pointed and slanted tip to reach the blade and cut the carpet;

loosening an edge of the carpet;

placing the carpet cutting apparatus to the loosened edge of the carpet;

anchoring a first end of a cable to a power driven winch and anchoring a second end of the cable through a diverter either directly to the carpet cutting apparatus or through a pulley to the carpet cutting apparatus;

energizing the power driven winch to apply a pulling force to the first end of the cable;

placing a foot of an operator at a foot area of the carpet cutting apparatus; and, pulling the carpet cutting apparatus wherein the front pointed and slanted tip of the bottom plate of the carpet cutting apparatus punctures the carpet which moves along the front pointed and slanted tip to reach the blade of the carpet cutting apparatus and cut the carpet.

7. The method as claimed in claim 6, wherein the second end of the cable is anchored through the pulley to the carpet cutting apparatus, wherein the carpet cutting apparatus comprises a first cutting apparatus and a second carpet cutting apparatus, further anchoring a first end of a second cable to the first carpet cutting apparatus and a second end of the second cable with the second carpet cutting apparatus with the second cable passing through the pulley, providing a third cable having a first end engaged with a first clamp and a second end engaged with a second clamp to capture strips of carpet, with the third cable passing through the pulley, wherein the pulley is in between the first end of the second cable and the second end of the second cable.

8. The method as claimed in claim 6, wherein the diverter is capable of moving relative to a base.

* * * * *